US011865467B2

(12) United States Patent
Whincup et al.

(10) Patent No.: US 11,865,467 B2
(45) Date of Patent: Jan. 9, 2024

(54) INFLATABLE ATTRACTIONS

(71) Applicants: Robin Whincup, Port Charlotte, FL (US); Michael Robin Whincup, radenton, FL (US)

(72) Inventors: Robin Whincup, Port Charlotte, FL (US); Michael Robin Whincup, radenton, FL (US)

( * ) Notice: Subject to any disclaimer, the term of this patent is extended or adjusted under 35 U.S.C. 154(b) by 0 days.

(21) Appl. No.: 18/049,567

(22) Filed: Oct. 25, 2022

(65) Prior Publication Data

US 2023/0062317 A1 Mar. 2, 2023

Related U.S. Application Data

(63) Continuation of application No. 17/620,299, filed as application No. PCT/US2020/038356 on Jun. 18, 2020, now Pat. No. 11,511,207.

(60) Provisional application No. 62/863,069, filed on Jun. 18, 2019.

(51) Int. Cl.
*A63G 31/12* (2006.01)
*A63H 27/10* (2006.01)

(52) U.S. Cl.
CPC ..... *A63G 31/12* (2013.01)

(58) Field of Classification Search
CPC . A63G 1/08; A63G 5/00; A63G 31/12; A63H 27/10; A63B 5/11
USPC ..... 472/117, 128, 134; 446/220, 224
See application file for complete search history.

(56) References Cited

U.S. PATENT DOCUMENTS

| | | | | |
|---|---|---|---|---|
| 1,641,607 | A | 9/1927 | Spatz | |
| 4,556,391 | A * | 12/1985 | Tardivel | A63H 33/00 52/2.21 |
| 9,855,470 | B1 | 1/2018 | Cassidy | |
| 2007/0167246 | A1 | 7/2007 | McKee et al. | |
| 2009/0286449 | A1 | 11/2009 | Tsai | |
| 2010/0048310 | A1 | 2/2010 | Ochi | |
| 2014/0155181 | A1 | 6/2014 | Zhang | |
| 2014/0170930 | A1 | 6/2014 | Gordon | |
| 2016/0271502 | A1 | 9/2016 | Ochi | |
| 2018/0001125 | A1 | 1/2018 | Adams | |

OTHER PUBLICATIONS

Anonymous: "Sports Inflatable Hire—Fun Inflatables—Total Wipe-out Sweeper", Shoot4goal—Fact Sheet, retrieved Dec. 15, 2021, <URL:https://www.shoot4goal.com/sports-inflatable-hire/fun-inflatables/total-wipeout-sweeper>.

Kidwise: "Arc Arena II Sport Boune House Kidwise", Amazon, retrieved Dec. 15, 2021, <URL:https://www.amazon.com/exec/obidos/ASiN/B003tC4VA2/ezvid02-20>.

(Continued)

*Primary Examiner* — Kien T Nguyen
(74) *Attorney, Agent, or Firm* — IPkey PLLC; John W. Zerr

(57) ABSTRACT

The present disclosure provides inflatable attractions, including inflatable attachments for attractions and attraction parks having such inflatable attractions. The inflatable attractions represent a significant advancement in safety, and include a central column, a first arm extending away from the central column, a second arm extending away from the central column, and at least one inflatable air chamber extending through at least one of the first arm or the second arm.

5 Claims, 13 Drawing Sheets

(56) References Cited

OTHER PUBLICATIONS

International Search Report dated Sep. 3, 2020, issued in corresponding International Application No. PCT/US2020/038356, filed on Jun. 18, 2020, 3 pages.
Written Opinion of the International Searching Authority dated Sep. 3, 2020, issued in corresponding International Application No. PCT/US2020/038356, filed on Jun. 18, 2020, 6 pages.

* cited by examiner

INFLATABLE ATTRACTIONS

CROSS-REFERENCES TO RELATED APPLICATIONS

The present application is a continuation of U.S. application Ser. No. 17/620,299, filed Dec. 17, 2021, which is a National Stage of International Application No. PCT/US2020/038356, filed Jun. 18, 2020, which claims the benefit of and priority to U.S. Provisional Application Ser. No. 62/863,069, filed Jun. 18, 2019, the entirety of which are hereby incorporated by reference for all purposes.

SUMMARY

The present disclosure provides inflatable attachments for attractions such as "wipeout" style attractions and other action games. The present disclosure also provides attractions that include such attachments, in addition to inflate-a-parks, trampoline parks, water parks, carnivals, and other attraction parks that include such attachments and/or attractions. The inflatable attachments and attractions represent a significant advance in safety, portability, and economy, owing to the inflatable structures described below.

These innovations, taken individually or in combination, contribute to the improved safety and easier setup/takedown/transportation of attractions, such as "wipeout" style attractions. While the following detailed description describes the innovations in the context of a "wipeout" style attraction, it is contemplated that the attractions are applicable to alternative attractions.

This summary is provided to introduce a selection of concepts in a simplified form that are further described below in the Detailed Description. This summary is not intended to identify key features of the claimed subject matter, nor is it intended to be used as an aid in determining the scope of the claimed subject matter.

BRIEF DESCRIPTION OF THE SEVERAL VIEWS OF THE DRAWINGS

The foregoing aspects and many of the attendant advantages of the present disclosure will become more readily appreciated as the same become better understood by reference to the following detailed description, when taken in conjunction with the accompanying drawings, wherein.

Figure 1:
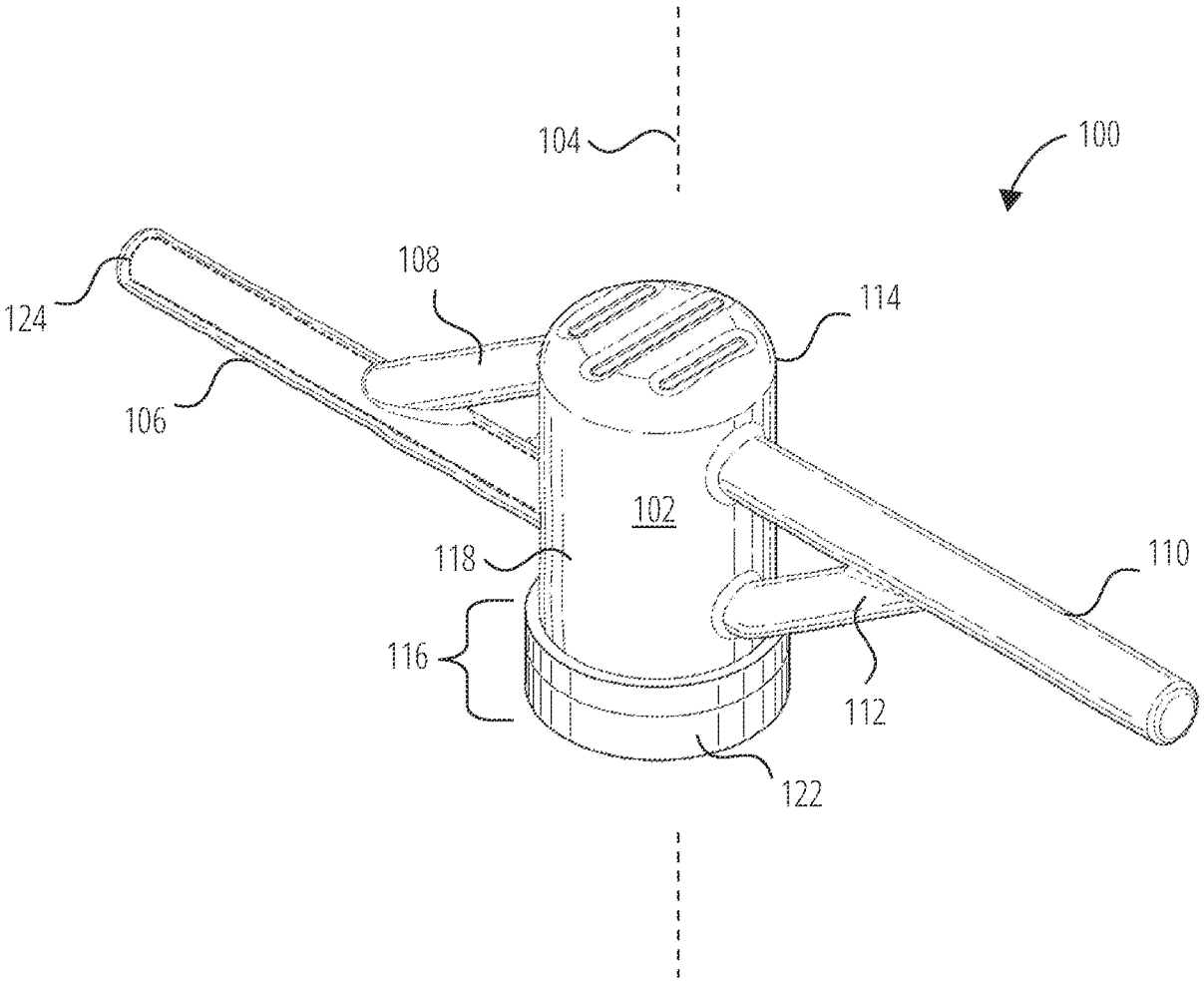
FIG. 1 shows an upper right perspective view of an inflatable attachment according to a representative embodiment of the present disclosure.

The present disclosure provides inflatable attachments (e.g., inflatable "sweepers") for attractions, in addition to attractions including such attachments, and inflate-a-parks, trampoline parks, water parks, carnivals, and other attraction parks that include such attachments and/or attractions. The inflatable attachments and attractions represent a significant advance in safety, portability, and economy, in part due to the inflatable structures described below.

The present disclosure provides inflatable attachments and attractions suitable for "wipeout" style attractions, action games, inflate-a-parks, trampoline parks, carnivals, and other such attractions. The inflatable attachments and attractions are inherently safe because one or more inflatable structures provide rigidity, instead of rigid frame elements that have historically been constructed from steel, aluminum, other metal, or similarly rigid material.

As used herein, "inflatable structures" include one or more inflatable air chambers, bladders, pockets, or the like constructed from a flexible material (e.g., vinyl, rubber, textile, or similar material), which may be inflated to an operating pressure (e.g., 50-100 psi, or otherwise greater than atmospheric pressure) with air or other gases, such as from a blower, air compressor, or other pneumatic source.

Generally, inflatable structures are safer than rigidly-framed structures (e.g., pad-on-metal-frame structures) because they inherently absorb impact when contacting human players or operators, unlike rigid frame elements (e.g., metal or plastic beams, rods, tubes, plates, and the like), which are inherently dangerous and must be covered in padding in order to absorb impact. Furthermore, the safety of a properly-maintained inflatable structure does not deteriorate over time. By comparison, attractions with rigid frame elements may become dangerous over time as the protective padding deteriorates, is removed, wears down, or is otherwise compromised such that it exposes the underlying rigid frame elements, which can injure players.

In this description, inflatable structures may be partially or entirely formed by an outer skin of the sweeper or attraction, e.g., a vinyl or a textile exterior material with air-tight seams that are cold-welded or otherwise sealed. In some embodiments, the inflatable structures may be formed not from the outer skin, but from a separate inflatable structure located within the outer skin, e.g., chamber-within-chamber construction. Such embodiments provide improved resistance to pressure loss as a result of punctures to the outer skin.

Some of the sweepers and attractions described do not include any rigid frame elements. However, some embodiments do include one or more inflatable structures and one or more rigid frame elements in locations and configurations that are safe for the players and operators. For example, some sweepers include a rigid base (e.g., a 48"×¾" plywood panel) at an interface between the sweeper and a motion base. In some embodiments, the rigid base includes a metal frame configured for reversible coupling to the motion base.

FIG. 1-FIG. 6 show a representative and non-limiting inflatable attachment 100 or sweeper 100 (hereinafter referred to as a "sweeper"), such as may be made, sold, or used as part of an attraction such as a "wipeout" style attraction described below with respect to FIG. 7-FIG. 12. In particular, the sweeper 100 is configured for mounting to an electromechanical motion base having a motor that drives an output shaft or similar motion element, such as motion bases manufactured by Galaxy Multi Rides of Port Charlotte, FL The motion base causes the sweeper 100 to spin or turn and therefore move or "sweep" past one or more players standing within its sweep radius. In order to avoid being knocked over, players duck or jump as the sweeper's arms move past them. Although the term "sweeper" is used throughout this description to facilitate understanding, it shall be appreciated that the present disclosure is directed to attachments for attractions, and is not limited to attachments that "sweep," and includes attachments configured to be driven by a motion base in other non-sweeping manners, for example random or orbital motion.

The sweeper 100 represents a significant advancement in safety due to its inclusion of one or more inflatable air chambers, which are configured to remain rigid, yet to absorb impacts and resist degradation. At least some parts of sweeper 100 do not have rigid frame elements, which could otherwise become exposed and cause human injury. Rather, the one or more inflatable air chambers eliminate this potentially dangerous failure mode.

The sweeper 100 has a central column 102 (with a central axis 104 extending therethrough), a first arm 106, an optional first brace 108 connecting the first arm 106 to the central column 102, an optional second arm 110, and an optional second brace 112 connecting the second arm 110 to the central column 102. As described below, the central column 102, first arm 106, first brace 108, second arm 110, and second brace 112 each include one or more inflatable structures formed from an outer skin 114, e.g., a vinyl, air-impermeable textile, or similar material. Accordingly, the outer skin 114 may be formed from panels that are sewn, bonded, and otherwise joined together. Where the outer skin 114 forms one or more air chambers as described below, the seams or other connections between panels should be air-tight to prevent inadvertent air loss from the air chamber(s) when the sweeper 100 is pressurized. Accordingly, the seams may be cold welded, taped, adhered, sewn, and/or otherwise constructed to form an air-tight air chamber.

Figure 2:
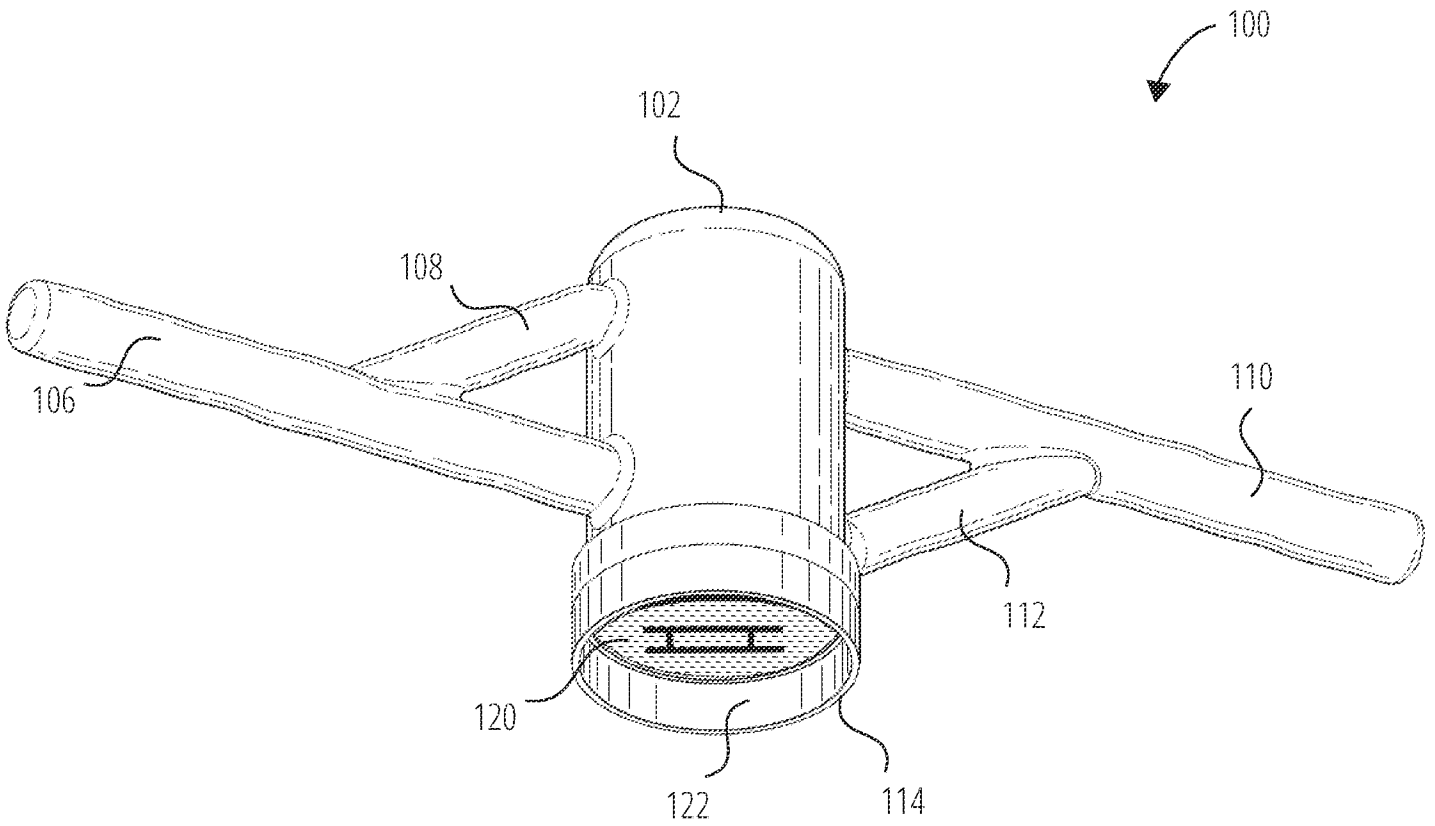
FIG. 2 shows a lower left perspective view of the inflatable attachment of FIG. 1.

The central column 102 includes a base 116 and a trunk portion 118. The base 116 is configured to support the central column 102, arms, and braces atop the motion base (which is generally separate from the sweeper 100). Referring to FIG. 2, the base 116 includes an interface surface 120, which is configured for coupling to an interface surface of the motion base. In some embodiments, the interface surface 120 of the base 116 is a downward-facing surface of a rigid panel (e.g., a 48"×¾" plywood panel or similar), which provides a stable platform to transfer torque from the motion base to the sweeper 100. The rigid panel may be optionally covered in padding for even greater safety. In some embodiments, the rigid panel of the base 116 is bolted or otherwise affixed to a metal sub-frame configured for reversible coupling to the motion base.

When so coupled to the motion base via the interface surface 120, the base 116 supports the sweeper 100 during rotational motion, pivotal motion (in some embodiments), and at rest. Although the interface surface 120 may be formed entirely by the outer skin 114 (i.e., a soft material), in some embodiments it may be reinforced by a backing plate, panel, flange, or similar structure located in the base 116 (such as the wood panel described above, which is not a rigid frame element within the meaning of this disclosure). An optional skirt 122 conceals the interface surface 120 for safety and/or cosmetic reasons, and may be formed of vinyl, textile, or the like. Although the base 116 has a round shape in this non-limiting embodiment, it could be triangular, square, hexagonal, or other shape in other embodiments. The base 116 generally has a diameter ranging from about 40 inches to about 80 inches, although this is not limiting. In some embodiments, the base 116 is a lower surface of the trunk portion 118, described below.

Referring again to FIG. 1 and FIG. 4, the trunk portion 118 of the central column 102 may be tied, sewn, welded, glued, bonded, or otherwise fixed to the base 116. Trunk portion 118 is an elongate portion of the central column 102 that provides an anchor point for the arms and braces (which can be thought of as branches), and also acts as an axle that turns the arms and braces about central axis 104 when driven by the motion base. The dimensions of the trunk portion 118 generally depend on the distance of the arms relative to the base 116 (i.e., an arm height), along with aesthetic considerations. However, it is generally an elongate portion that extends away from the base 116. The base 116 and trunk portion 118 need not be distinct components. Indeed, in some embodiments, a lower surface of the trunk portion 118 forms the base 116. In some embodiments, the trunk portion 118 sits atop a flange, plate, panel, or other similar structure of the base 116.

Figure 3:
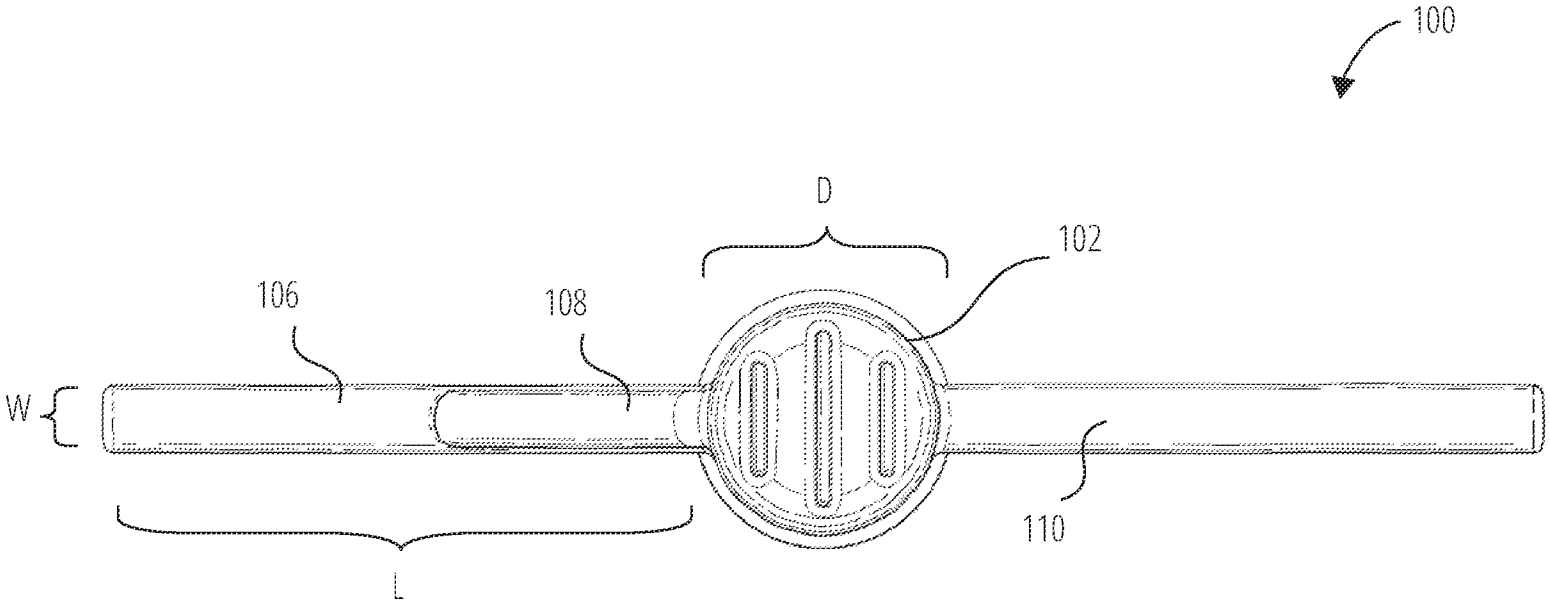
FIG. 3 shows a top plan view of the inflatable attachment of FIG. 1.
Figure 4:
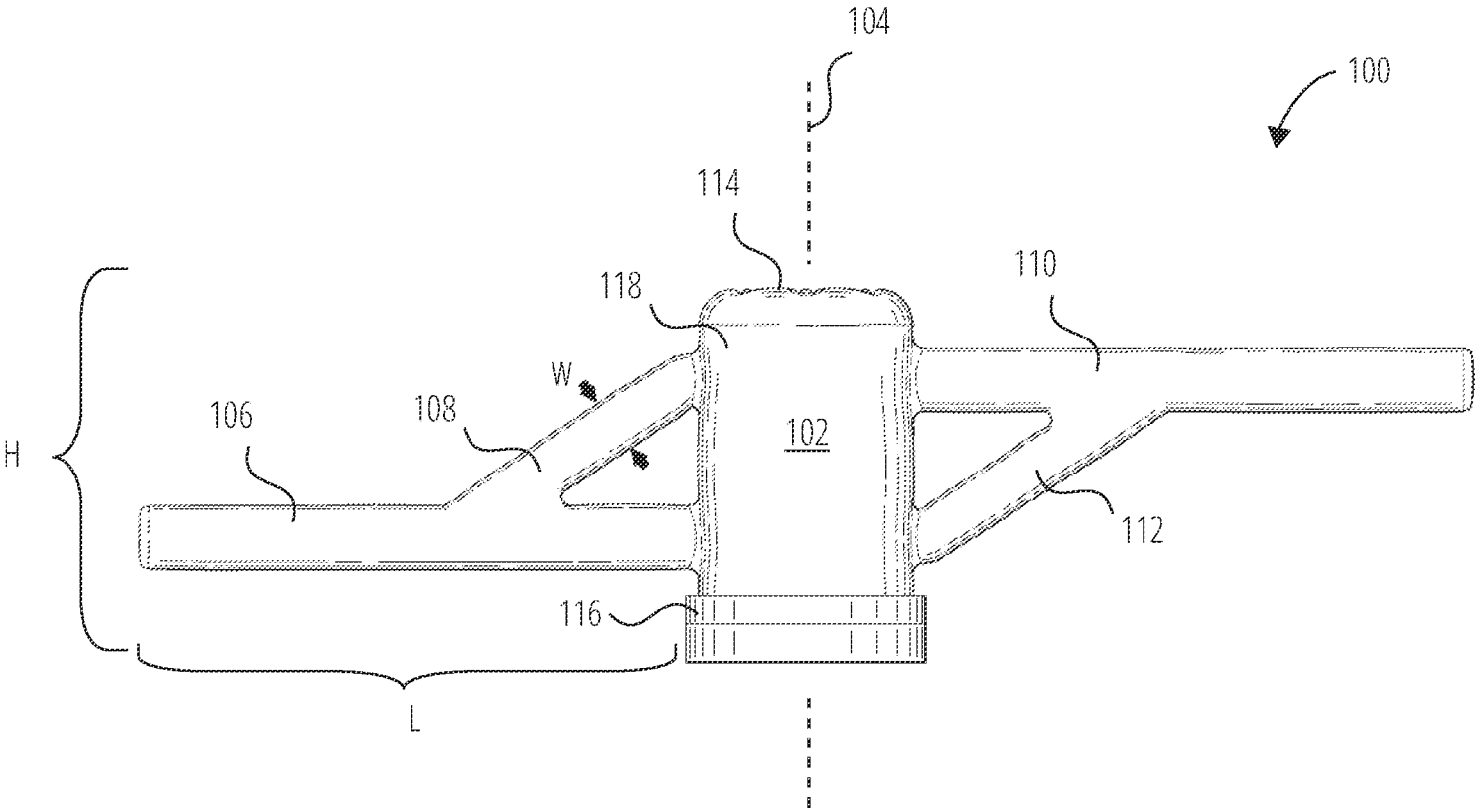
FIG. 4 shows front elevation view of the inflatable attachment of FIG. 1.
Figure 6:
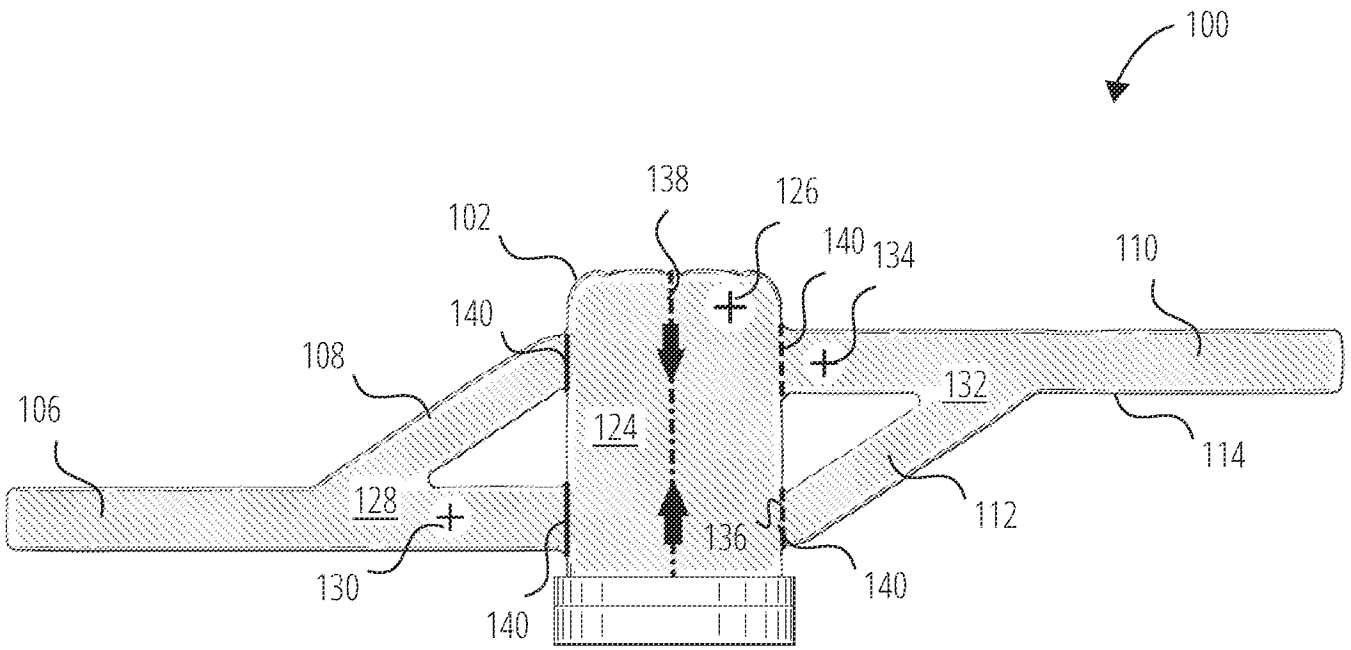
FIG. 6 shows a schematic front elevation view of the inflatable attachment of FIG. 1, according to another representative embodiment of the present disclosure.

Referring to FIG. 3 and FIG. 4 together, the central column 102 has a representative height, H, ranging from about 24 inches to about 144 inches, and a representative diameter, D, ranging from about 30 inches to about 80 inches, e.g., 40 inches. As shown in FIG. 6, some embodiments of the sweeper 100 include one or more optional internal ties 138 disposed in the central column 102, which connect the base 116 to the trunk portion 118 (e.g., an internal surface of a top portion of the trunk portion 118). Such internal ties 138, when tightened in tension, provide the sweeper 100 greater rigidity when pressurized and generally improve its appearance. The internal ties 138 may be tied, sewn, welded, glued, or similarly attached to the base 116 and trunk portion 118.

As noted above and described below, the central column 102 includes at least one inflatable structure configured to maintain the rigidity when pressurized to above atmospheric pressure, rather than a rigid frame member. However, some embodiments do include a rigid frame member in the central column 102 (e.g., a flange or backing plate disposed between the base 116 and the trunk portion 118 for greater torsional stiffness), provided that the arms of the sweeper 100 are provided with inflatable structures instead of rigid frame elements.

The following description provides details of the first arm 106 and the first brace 108, which generally apply to the optional second arm 110 and the optional second brace 112, respectively.

Figure 9:
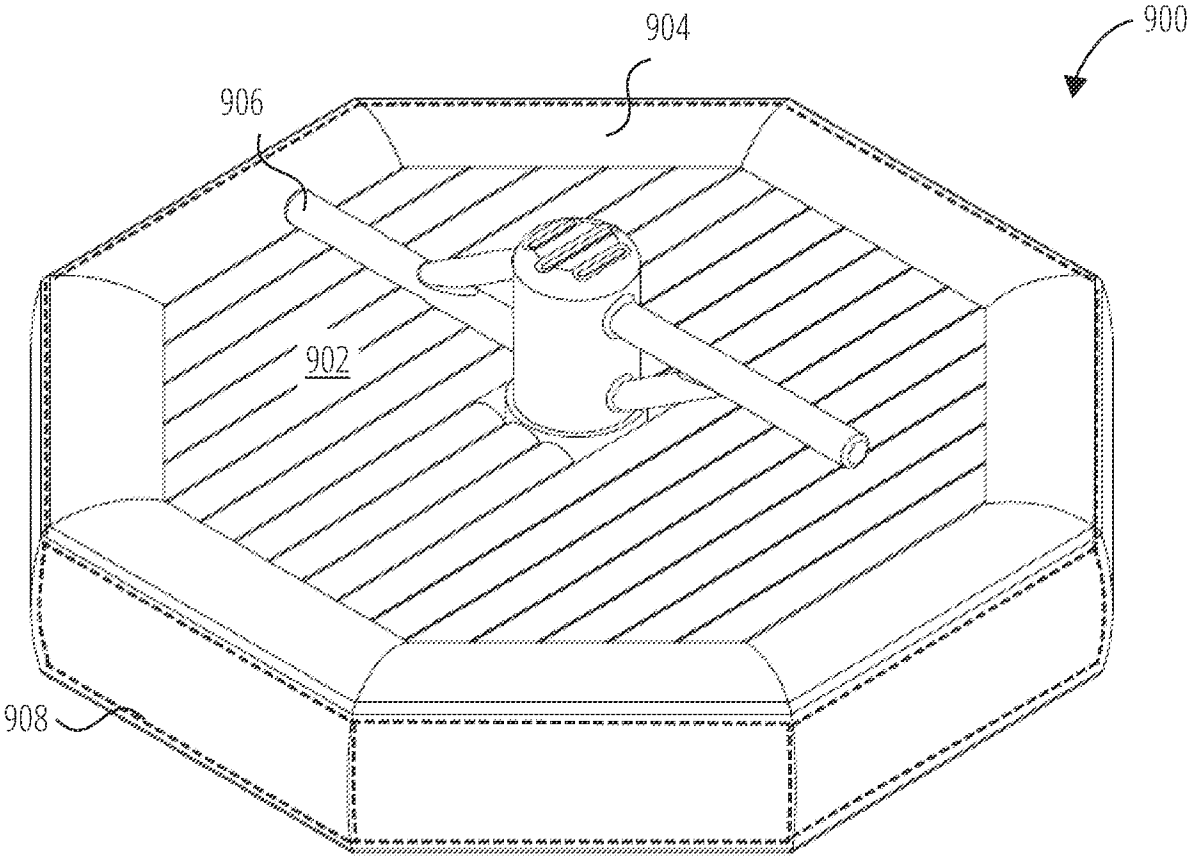
FIG. 9 shows an upper perspective view of an inflatable attraction according to yet another representative embodiment of the present disclosure.
Figure 10:
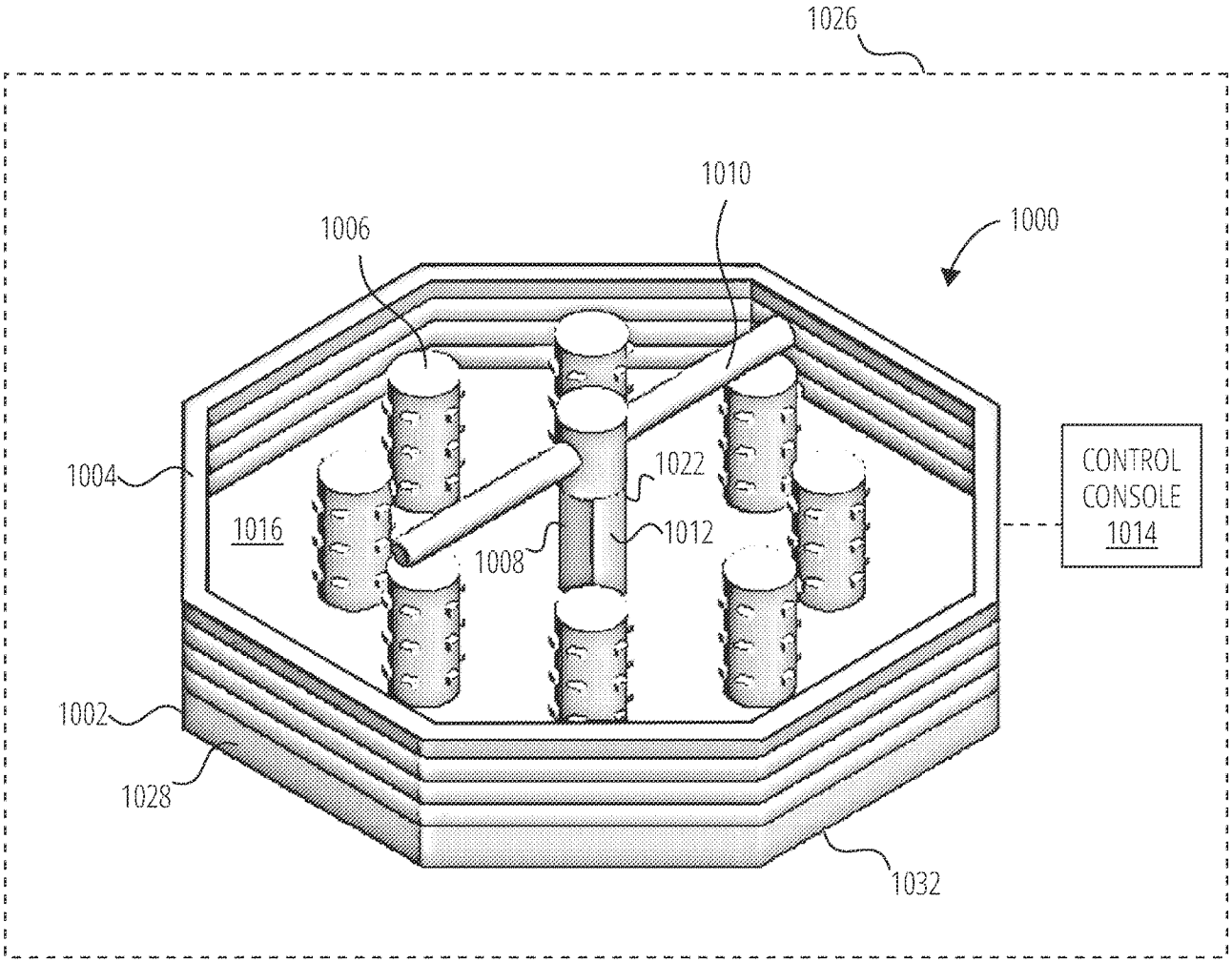
FIG. 10 shows an upper perspective view of an inflatable attraction according to yet another representative embodiment of the present disclosure.

As shown in FIG. 3 and FIG. 4, the first arm 106 extends radially outwardly from the central column 102 and is configured to "sweep" past one or more players (who may be standing on podiums such as shown in FIG. 10) when the sweeper 100 rotates. As noted above and described below, the first arm 106 includes at least one inflatable structure configured to maintain the rigidity when pressurized, rather than a rigid frame member. Representative lengths, L, of the first arm 106 are at least about 24 inches, e.g., from 36 inches to inches, and representative widths, W, range from about 8 inches to about 30 inches. The length and the width may vary, depending on the particular application. For example, when the sweeper 60 is configured for use in an attraction such as shown in FIG. 7-FIG. 12, the length of the first arm 106 may depend on the radial spacing between each podiums 1006 and the central column 102. The length of the first arm 106 may be sufficiently long that an end thereof extends past the podium when it is configured to form part of an attraction as described below. The first arm 106 is cylindrical in this representative embodiment, but may have a different shape in different embodiments, e.g., square, octagonal, etc.

As shown in FIG. 4, the first arm 106 is attached to and extends away perpendicularly from a side surface (e.g., a radially outer surface) the central column 102 in the illustrated embodiment; however, this is representative, not limiting. In some embodiments (not shown), the first arm extends diagonally away from the central column 102 toward an upper or lower end thereof (i.e., diagonally away from or toward the ground), thereby forming a non-normal angle (e.g., an acute angle) with the central axis 104 when viewed from the side (perpendicular to the central axis 104) as shown in FIG. 4. In some embodiments (not shown), the first arm 106 extends diagonally away from the central column 102, when viewed along the central axis 104 (e.g., as in FIG. 3).

Referring still to FIG. 4, the optional first brace 108 provides a reinforcing connection between the first arm 106 and the central column 102 that prevents the first brace 108 from sagging due to gravity. In addition, the first brace 108 prevents the first arm 106 from deflecting excessively when it contacts a player during use. The first brace 108 has representative widths, w, ranging from about 6 inches to about 18 inches, and representative lengths ranging from about 24 inches to about 60 inches. In the illustrated embodiment, the first brace 108 connects with the central column 102 and extends downwardly and diagonally therefrom to an intermediate location along the first arm 106, such that the central column 102, first arm 106, and first brace 108 form a triangle. The distance between the central column 102 and the intermediate location along the first arm 106 may be about 20% to about 80% of the total length, L, of the first arm 106. In some embodiments, the first brace 108 is inflatable. That is, an air chamber extends through the first brace 108, which may be a separate air chamber or an air chamber that is contiguous with another part of the sweeper 100, e.g., the first arm 106 and/or the central column 102. In some embodiments, the first brace 108 is not inflatable, but instead has a non-inflatable structure formed from foam or a similar material that is relatively stiff, but safe. Some embodiments may even include a rigid frame member in the first brace 108, provided that it is well-padded and connects with the first arm 106 at an intermediate location that is not more than 50% along the total length thereof. In some embodiments, first brace 108 is detachable from the central column 102 and first arm 106, e.g., with VELCRO®, zipper, snaps, or similar reversible connection.

The optional second arm 110 is similar to the first arm 106 except that it is positioned at a different height on the central column 102 in the illustrated embodiment (although this is not limiting), and extends away from an opposite side of the central column 102. The first arm 106 located at a first height relative to the base 116, whereas the second arm 110 is located at a second height. The specific heights of the arms may vary between embodiments. For example, some embodiments include one or more arms connected to the central column 102 at about 8-12 inches from the base 116 such that a player can jump over it. First arm 106 is an example of such a "jump" arm. Additionally or alternatively, some embodiments include one or more arms connected to the central column 102 at about 24-48 inches from the base 116 such that a player can duck under it. Second arm 110 is an example of such a "duck" arm. In some embodiments, the first arm 106 and the second arm 110 are at the same height. In some embodiments, the second arm 110 differs in shape, size, and/or position from the first arm 106.

The optional second brace 112 is similar to the first brace 108, except that it is located below the second arm 110, rather than above it. Accordingly, the second brace 112 connects with the central column 102 and extends upwardly and diagonally therefrom to an intermediate location along the second arm 110, such that the central column 102, second arm 110, and second brace 112 form a triangle. The position, dimensions, and orientation of the second brace 112 are representative. In some embodiments, the second brace 112 differs in shape, size, and/or position from the first brace 108.

Except where described herein, in the embodiments of FIG. 1-FIG. 6, none of the first arm 106, first brace 108, second arm 110, second brace 112, or trunk portion 118 contain any rigid frame elements such as tubes, beams, or similar solid and rigid frame elements made from metal such as steel or aluminum, which are commonly found in existing attractions and present a safety risk. This does not include the panel and sub-frame (e.g., plywood panel) which are located at the interface surface 120 of the base 116 in some embodiments. The absence of solid and rigid frame elements such as steel and aluminum eliminates certain safety risks, but presents a challenge of maintaining sufficient rigidity in the sweeper 100. The sweepers of the present disclosure solve this problem by utilizing one or more inflatable air chambers to maintain rigidity, as described below. In some embodiments, the sweepers also utilize structural elements such as optional first brace 108 to maintain rigidity. In some variations, the central column 102 does comprise one or more rigid frame elements; however, the arms do not comprise rigid frame elements.

To clarify, protective exterior padding, foam cores (such as may be found in the optional braces of the present disclosure), grommets, zippers, seams, and the like are not considered "rigid frame elements" in this disclosure. For example, the sweeper 100 generally does not have any rigid frame elements (except where described herein), yet can have optional protective exterior padding on any of the described portions, including the first arm 106 and the second arm 110, in order to further protect players.

Figure 5:
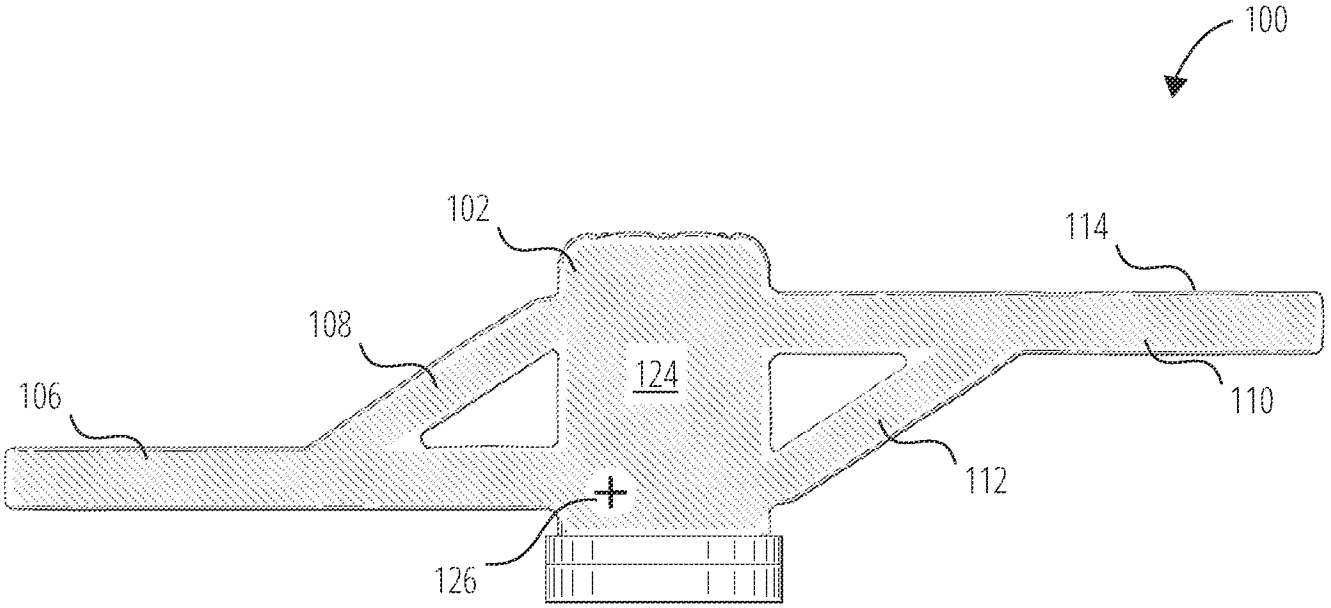
FIG. 5 shows a schematic front elevation view of the inflatable attachment of FIG. 1, according to a representative embodiment of the present disclosure.

FIG. 5 shows a schematic section view of the sweeper 100 of FIG. 1, showing one representative air chamber configuration. In this illustrated embodiment, the central column 102, first arm 106, first brace 108, second arm 110, and second brace 112 together form a single, fluidly-connected (contiguous), and sealable air chamber 124 that is configured to be inflated to an operating pressure (e.g., about 20 psi to about 100 psi), then operated at the operating pressure, periodically re-inflated if necessary, and then deflated if necessary for service and/or transportation. The air chamber 124 may be inflated and deflated via one or more valves 126 (e.g., a Schrader valve, Presta valve, or other pneumatic valve) located on the central column 102 or anywhere else on the sweeper 100. In some embodiments, the valve 126 is a blower hookup configured to provide the air chamber 124 a continuous supply of pressurized air. Advantageously, embodiments having a single air chamber 124 are quick-to-inflate and deflate, and can utilize a single valve 126 for greater economy. The air chamber 124 is formed by the outer skin 114 of the sweeper 100; however, in some embodiments, the air chamber 124 may be formed by an internal chamber that is separate from the outer skin 114. Such chamber-within-a-chamber construction advantageously prevents the loss of pressure in the air chamber 124 if the outer skin 114 ruptures. Any of the sweepers described herein may have such optional chamber-within-a-chamber construction.

FIG. 6 shows another representative air chamber arrangement in the sweeper 100, comprising three separate air chambers. In the illustrated embodiment, the central column 102 includes a first inflatable air chamber 124 that is inflatable/deflatable via a first valve 126. The first arm 106 and first brace 108 comprise a second inflatable air chamber 128 that is inflatable/deflatable via a second valve 130. The second arm 110 and second brace 112 comprise a third inflatable air chamber 132 that is inflatable/deflatable via a third valve 134. The air chambers are formed by the outer skin 114, and are separated from each other by internal barriers 140 (e.g., vinyl panels), such that the loss of pressure in one chamber does not cause any of the other air chambers to lose pressure. Advantageously, separated air chambers enable different chambers to operate at different pressure levels. For example, the first air chamber 124 may be configured to operate at a first, relatively high pressure (e.g., 100 psi) for greater torsional stiffness, while the second air chamber 128 and third air chamber 132 are configured to operate at a second, lower pressure (e.g., 60-80 psi), for greater safety.

In some embodiments, two or more air chambers are fluidly connected by at least one optional equalizing passage 136 extending through one or more of the barriers 140, such passages being configured to permit movement of a fluid between a first inflatable air chamber and a second inflatable air chamber. Such passages 136 are shown in FIG. 6 as extending through the barriers 140 separating air chamber 124 from air chamber 132. In such embodiments, the passage 136 has a size (area) that is relatively small compared to an area of the barrier 140 between the two connected air chambers, e.g., about 1-6 inches, or about 5%-50% of the area of the barrier 140. Such equalizing passages 136 enable the different air chambers to normalize pressures, but at a slower rate. This assists with maintaining uniform pressure throughout the sweeper 100 during operation, while preventing other air chambers from deflating suddenly in response to the loss of pressure in one air chamber.

The features described above with respect to the non-limiting embodiments of FIG. 1-FIG. 6 are representative. Embodiments of the sweeper 100 may include any one or more of the following representative features:

- an inflatable arm with no brace;
- an inflatable arm with a single brace;
- more than one brace per inflatable arm, e.g., an upper brace such as first brace 108, a lower brace such as second brace 112, and/or a brace connecting to different arms together;
- an inflatable arm with one or more detachable braces;
- an inflatable arm that is detachable from the central column;
- more than two inflatable arms (e.g., four arms disposed about the central column, at the same height or at different heights), with one or more braces per arm. For example, some embodiments also include an inflatable third arm and an inflatable fourth arm extending away from the central column 102, at different positions around its perimeter. Such embodiments optionally include a third brace and a fourth brace (e.g., inflatable braces or foam braces) extending diagonally from the central column 102 to the third arm and fourth arm, respectively.
- a plurality of braces that extend downwardly from the central column 102 (such as first brace 108), and/or a plurality of braces that extend upwardly from the central column 102 (such as second brace 112);
- at least one brace that connects to a side surface along the respective arm, e.g., to reduce deflection of the arm;
- at least one brace that connects a first arm to a second arm, e.g., to reduce deflection of the arm;
- at least one brace that has a different shape than the straight braces shown in FIG. 1-FIG. 6. For example, some embodiments include at least one curved brace. As another example, some embodiments include at least one brace that is triangle-shaped and/or has a web such that the brace does not leave an opening between the brace, arm, and central column.
- one contiguous air chamber extending through at least a first arm of the sweeper;
- one contiguous air chamber connecting all inflatable portions of the sweeper;
- one or more contiguous air chambers connecting two or more inflatable portions of the sweeper (e.g., the first arm 106 and first brace 108), but fewer than all portions of the sweeper (inflatable or otherwise);
- two or more air chambers separated by a barrier having one or more optional equalizing passages therethrough;
- one or more inflatable portions having internal structures such as internal ties;
  - at least a first arm attached to a side surface of the central column and having a length of at least 24 inches;
- at least one inflatable air chamber extending through at least a first arm, wherein the at least one inflatable air chamber is at least partially formed by an outer skin of the inflatable attachment and is configured to be inflated such that the first arm extends away from the side surface of the central column;
- one or more inflatable portions having internal structures such as internal ties;
- one or more portions (e.g., one or more braces and/or the central column) having a non-inflatable structure formed from foam or a similar material that increases strength while preserving safety;
- may be made, sold, or used as part of an attraction 144 (e.g., as described in FIG. 7-FIG. 12), which attraction may optionally have a cushion as shown in FIG. 13; and/or
- may be made, sold, or used as part of an inflate-a-park 142 (or a trampoline park, water park, amusement park, or similar attraction park).

Advantageously, the innovative inflatable attachments described herein are much safer than sweeper designs that include rigid and solid frame elements in the arms.

As described above, any of the inflatable attachments (including sweepers) of the present disclosure may be made, sold, or used as part of an attraction, e.g., a "wipeout" style attraction or other action game.

FIG. 7-FIG. 12 show representative inflatable attractions equipped with inflatable attachments of the present disclosure. Like the inflatable attachments (e.g., sweepers) described herein, the inflatable attractions represent improvements in safety, due to the use of one or more inflatable structures (e.g., air chambers). Any of the attractions described herein may be made, sold, or used as part of an attraction park (including an inflate-a-park, trampoline park, water park, amusement park, or similar attraction park).

Figure 7:
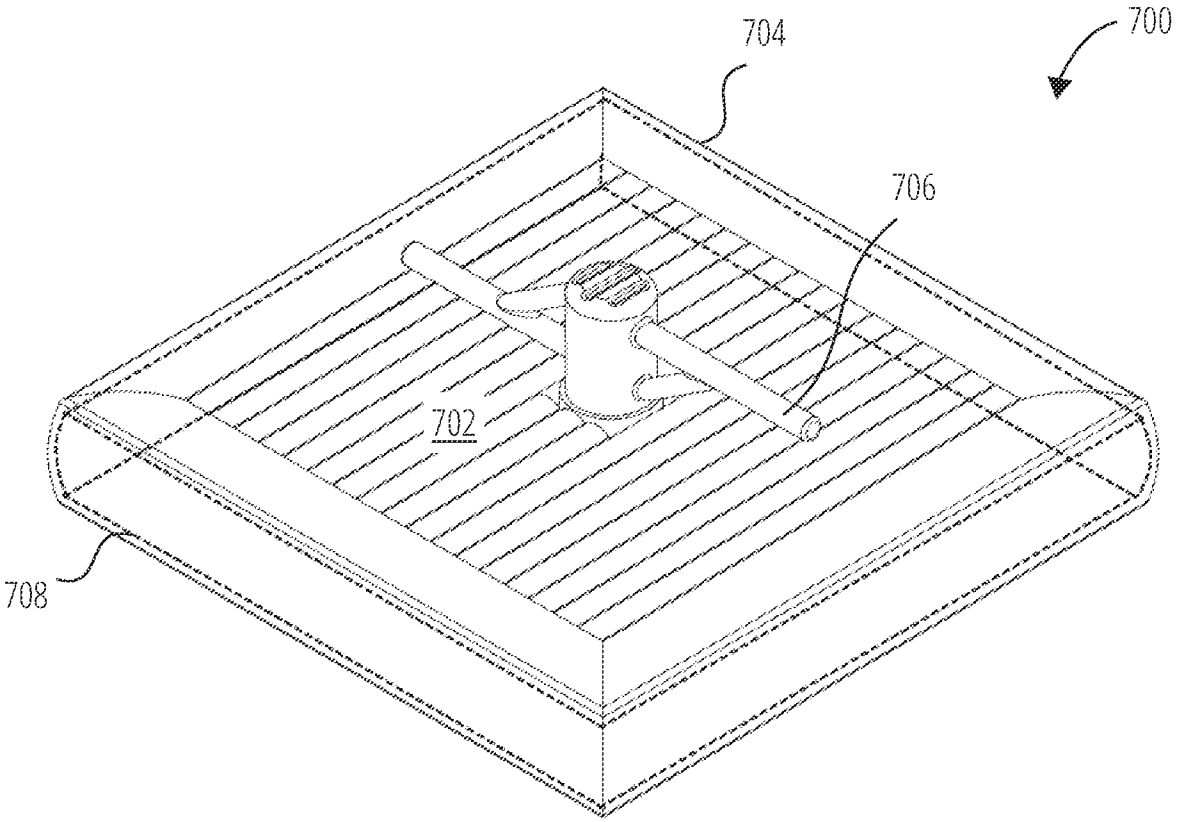
FIG. 7 shows an upper perspective view of an inflatable attraction according to a representative embodiment of the present disclosure.

FIG. 7 shows an inflatable attraction 700 having an inflatable base portion 702, and inflatable wall portion 704, and an inflatable attachment 706 (sweeper 706) formed in accordance with any of the embodiments described herein. The sweeper 706 is configured to be operably connected to a separate motion base.

In use, one or more players stand on base portion 702. The motion base turns the sweeper 706 about such that its arms "sweep" past the players, who can jump or duck to avoid being knocked over.

The base portion 702 and wall portion 704 includes at least one inflatable air chamber 708 that is formed by an outer skin thereof. Different embodiments have different air chamber configurations, for different advantages. For example, some embodiments include a single, contiguous air chamber 708 that occupies the entire base portion 702 and wall portion 704, while some embodiments include a plurality of separate air chambers 708 separated by an internal barrier (e.g., a first air chamber forming base portion 702 and a second air chamber forming wall portion 704), such that loss of pressure in one air chamber does not cause the other to lose pressure. Some such embodiments may include one or more optional passages through the barriers to allow normalization of pressure between air chambers (e.g., in the event of pressure loss in one chamber). Still other embodiments have a plurality of separate discrete air chambers. Some embodiments have a combination of the foregoing air chamber configurations.

Figure 8:
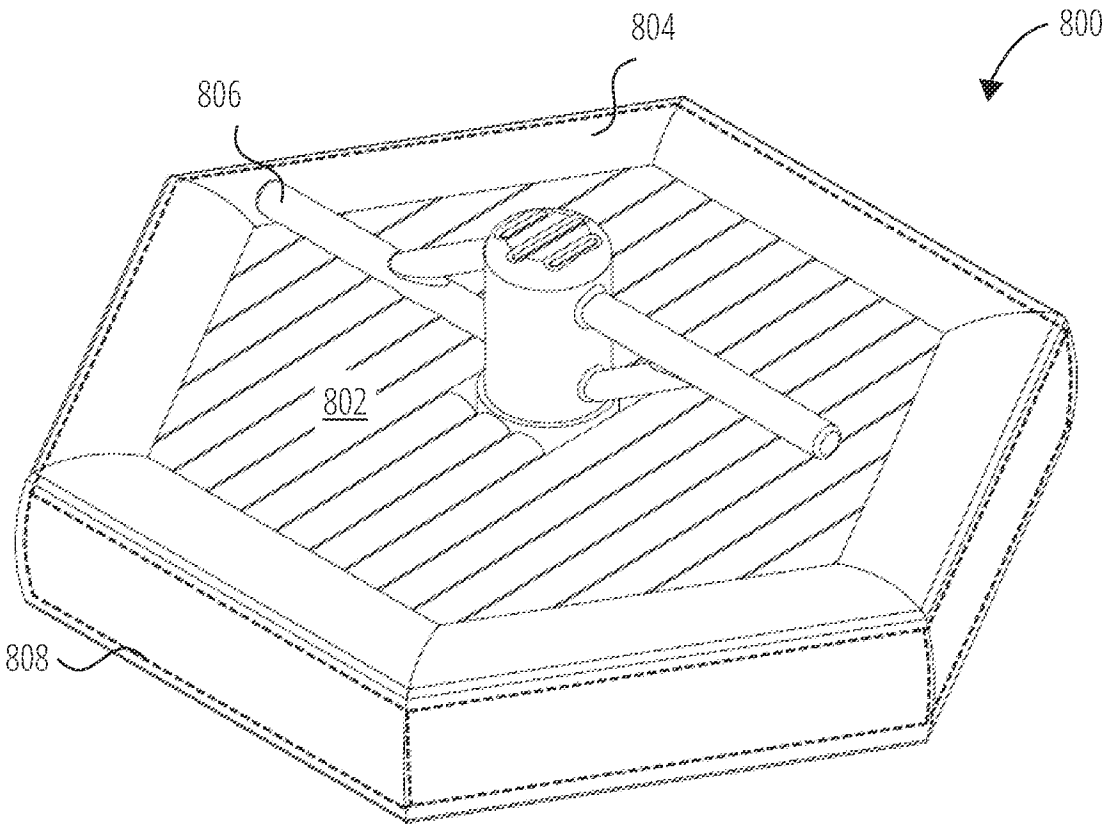
FIG. 8 shows an upper perspective view of an inflatable attraction according to another representative embodiment of the present disclosure.

FIG. 8 and FIG. 9 show additional inflatable attractions 800 and 900, respectively, which are similar to attraction 700, except that attraction 800 has a hexagonal wall portion 804, while attraction 900 has an octagonal wall portion 904. In particular, the attractions 800 and 900 include inflatable sweepers 806, 906, and at least one inflatable air chamber 808, 908 that is internal to the base portions and wall portions. As shown, the base portions and wall portions can have a variety of shapes, including additional shapes not shown in the figures (e.g., circular). In the illustrated embodiments, the base portions and the wall portions are integrally formed, i.e., sewn or bonded together to form a single contiguous outer skin (which may be formed of vinyl or similar material). In some embodiments, the base portion and wall portion can be distinct from each other, for example to facilitate installation, service, and transportation.

Figure 11:
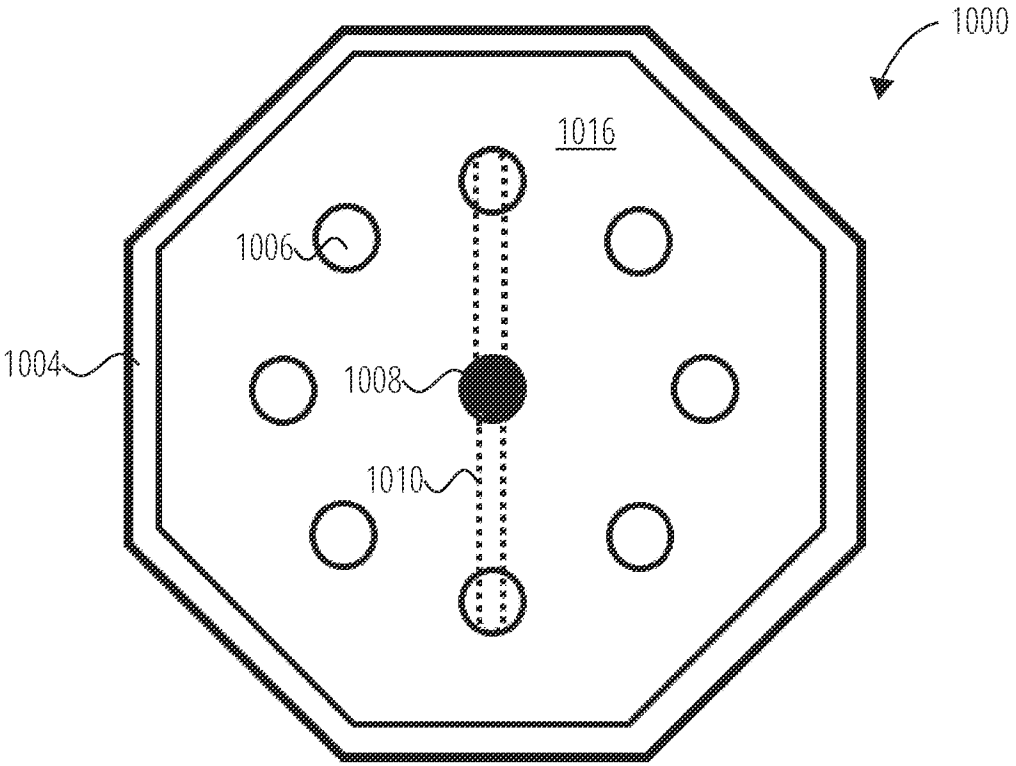
FIG. 11 shows a top plan view of the inflatable attraction of FIG. 10.
Figure 12:
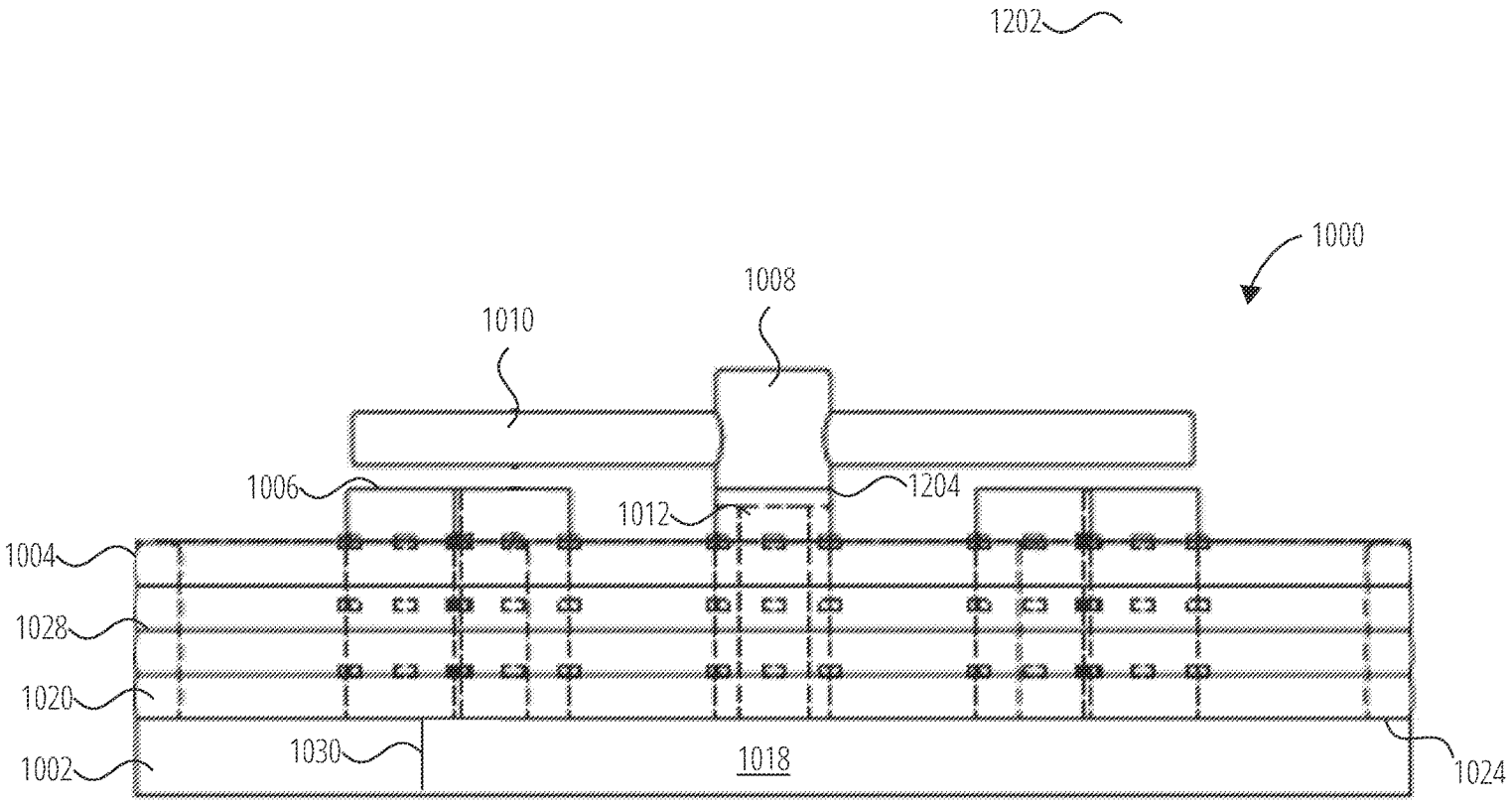
FIG. 12 shows a side elevation view of the inflatable attraction of FIG. 10.
Figure 13:
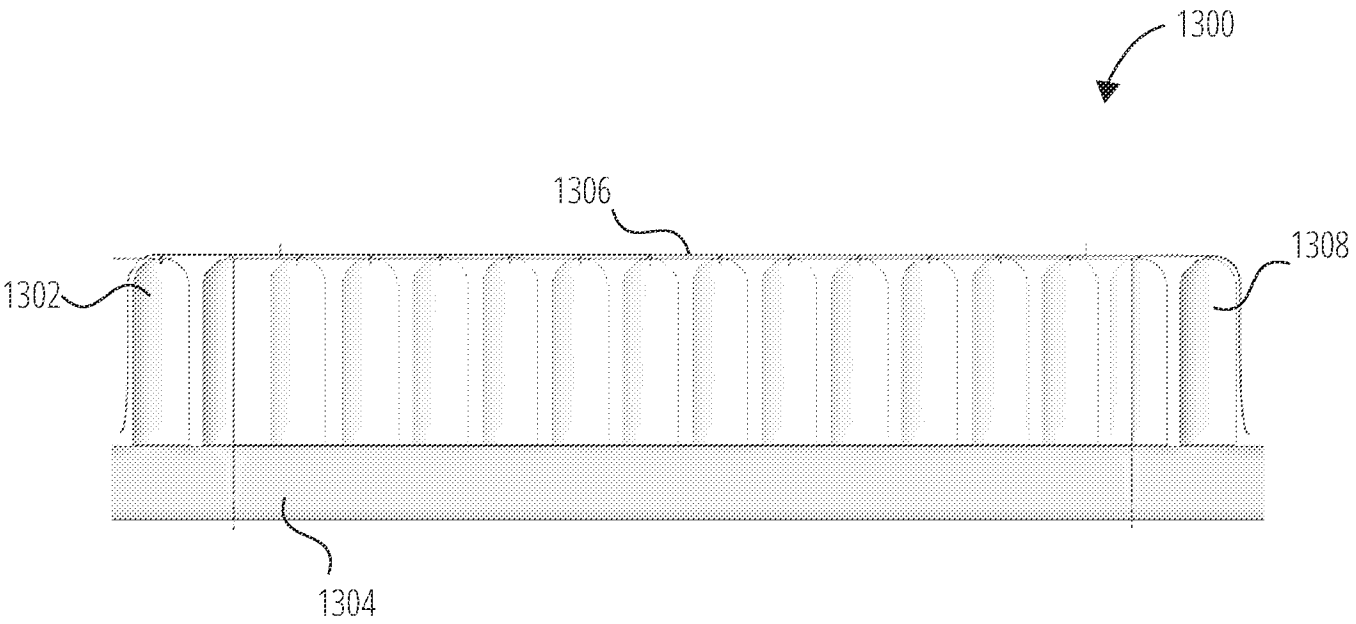
FIG. 13 illustrates a cushion 1300 in accordance with a representative embodiment of the present disclosure.

FIG. 10-FIG. 12 show an additional representative inflatable attraction 1000 having an inflatable base portion 1002 surrounded by an inflatable wall portion 1004, with a plurality of podiums 1006 positioned therein, a column 1008 (which is centrally located in this non-limiting embodiment), and an inflatable sweeper 1010 mounted atop the column 1008. The inflatable attraction 1000 (including the base portion 1002 and/or wall portion 1004) may be utilized together or independently with any of the inflatable attachments disclosed herein (such as sweeper 100), which may be easily removed from the motion base.

The column 1008 at least partially houses a motion base 1012 that is operably coupled with the sweeper 1010 in order to cause the sweeper 1010 to rotate about the column 1008. The motion base 1012 may be electrically connected to a control console 1014 that is configured to control the start, stop, speed, direction, and potentially other variables of the motion base 1012.

In use, the attraction 1000 works similar to those of FIG. 7-FIG. 9. Players stand on the podiums 1006 and either jump over/duck under the arms of the sweeper 1010 as it rotates atop the motion base, or get knocked off the podium 1006 into a landing area 1016, which may be filled with foam blocks or other padding.

The attraction 1000 and its individual portions are safer than known attractions, because at least a portion of the base portion 1002, the wall portion 1004, and/or the sweeper 1010 are constructed from one or more inflatable structures (i.e., air chambers).

The air chambers may be formed by the same material that forms an outer skin 1032 of the base portion 1002 and/or wall portion 1004, e.g., a vinyl or air-impermeable textile material. In some embodiments, the air chambers may be optionally formed not from the outer skin 1032, but from a separate air chamber located within the outer skin 1032, i.e., chamber-within-chamber construction. Such embodiments provide improved resistance to pressure loss in the event the outer skin 1032 ruptures.

In some embodiments, the attraction 1000 does not include any rigid frame elements (e.g., except for a panel and sub-frame at an interface surface between the sweeper 1010 and the motion base 1012). However, some embodiments include one or more inflatable structures (e.g., in one or more of the base portion 1002, wall portion 1004, and/or sweeper 1010) and one or more right frame elements in such a configuration that is safe for the players. For example, in some embodiments, the base portion 1002, wall portion 1004, and/or sweeper 1010 are formed from one or more inflatable structures; however, the podiums 1006 are supported by (padded) rigid frame elements (e.g., steel columns) to provide secure footing for players.

As shown in FIG. 11, the base portion 1002 has an octagonal shape, which could be circular, square, hexagonal, octagonal, or any other shape in other embodiments. The podiums 1006 are placed radially around the column 1008, with each podium 1006 being free-standing (rather than integrally-formed with the base portion 1002). Accordingly, each podium is configured to be bolted or otherwise secured to the floor, foundation, or ground to securely support the players. For example, each podium 1006 may have a frame and may be covered in foam, vinyl, and/or inflatable padding. In such embodiments, each podium 1006 extends through the base portion 1002 at positions inside a sweep radius of the sweeper 1010. Although each podium 1006 is placed the same distance away from the column 1008 in the illustrated embodiment, in other embodiments, one or more podiums 1006 may be located different distances away from the column 1008 such that different podiums 1006 have different difficulty levels (the sweeper 1010 moves more slowly past podiums 1006 placed nearer to the column 1008). Also, the number of podiums 1006 may differ between embodiments, e.g., two, three, four, five, six, seven, eight, nine, ten, or an even greater number for greater group fun.

As shown in FIG. 12, the inflatable base portion 1002 has a thickness of about 6 inches to about 36 inches (depending on the embodiment) in order to provide a high level of impact absorption. The base portion 1002 may have a single, contiguous inflatable air chamber 1018, may include a plurality of separate inflatable air chambers 1018 (e.g., discrete air chambers separated by a barrier 1030 such that fluid cannot move therebetween), or may include a plurality of fluidly interconnected air chambers 1018. The air chambers 1018 of the base portion 1002 may also interconnect with air chambers of other portions of the attraction 1000, including the wall portion 1004 and the sweeper 1010.

The inflatable wall portion 1004 has a height of about 24 inches to about 60 inches. The wall portion 1004, like the base portion 1002, may have a single, contiguous, inflatable air chamber 1020, a plurality of separate air chambers 1020 (e.g., separated by a barrier 1028), and/or a plurality of fluidly interconnected air chambers 1020. In this embodiment, the base portion 1002 is structurally connected to the wall portion 1004 (e.g., by sewing, welding, and/or adhesives). However, in some embodiments, the base portion 1002 and wall portion 1004 are not structurally connected, e.g., to facilitate assembly or shipping. In fact, some embodiments of the attraction 1000 include a wall portion 1004 but not a base portion 1002; such embodiments may be useful in trampoline parks, where a trampoline apparatus replaces the inflatable base portion 1002 shown herein.

In some embodiments, one or more air chambers 1018 of the base portion 1002 fluidly communicate with one or more air chambers 1020 of the wall portion 1004 such that the base portion 1002 and the wall portion 1004 comprise a single air chamber (or a fluidly interconnected air chambers). In an embodiment, the air chamber(s) of the base portion 1002 are separated from the air chamber(s) of the wall portion 1004 by a barrier 1024, such to maintain partial inflation in the event of a leak or rupture of the outer skin 1032.

Together, the base portion 1002 and the wall portion 1004 have a total height of about 30 inches to about 60 inches. In an embodiment, the base portion 1002 may have a height and the wall portion 1004 may have a height that are calculated such that the total height matches the depth of a recess or pit located in a floor of an inflate-a-park 1026 (or a trampoline park, water park, amusement park, or similar attraction park). This way, a top of the wall portion 1004 is configured to sit flush with the floor of the inflate-a-park.

As shown in FIG. 12, the motion base 1012 is removably connected to the sweeper 1010 at an interface 1022, such that the sweeper 1010 can be removed to facilitate transportation or maintenance, or to swap different sweepers. In one non-limiting example, the interface 1022 includes a downward-facing surface (of the sweeper 1010) and an upward-facing surface (of the motion base 1012). The structure of the interface 1022 is consistent with the interface surface 120 described above with respect to sweeper 100. This connection type between the sweeper 1010 and motion base 1012 is representative; some sweepers within the scope of the present disclosure include different coupling structures.

FIG. 13 provides a low-shock or zero-shock cushion 1300 that may be used with any attachment and/or attraction of the present disclosure, to further improve safety. Such a cushion 1300 provides a superior shock-absorbing structure, stemming from its construction. The cushion 1300 is constructed from a flexible shell 1302 (e.g., a vinyl shell) having a base 1304 and a top sheet 1306. Inside the shell 1302, a plurality of inflatable tubes 1308 (each of which has a height ranging from about two feet to about six feet) is sewn onto the base and to the top sheet. The cushion 1300 may be shaped and sized to fit on top of a base portion of the attraction (e.g., inside the landing area 1016 shown in FIG. 10), in order to absorb the shock of a player who has been knocked off a podium by any of the sweeper described herein.

Thus, the sweepers, attractions, and inflate-a-parks provided by the present disclosure represent a significant increase in both safety and fun.

The detailed description set forth above in connection with the appended drawings, where like numerals reference like elements, are intended as a description of various embodiments of the present disclosure and are not intended to represent the only embodiments. Each embodiment described in this disclosure is provided as an example or illustration and should not be construed as preferred or advantageous over other embodiments. The illustrative examples provided herein are not intended to be exhaustive or to limit the disclosure to the precise forms disclosed. Similarly, any steps described herein may be interchangeable with other steps, or combinations of steps, in order to achieve the same or substantially similar result. Unless stated otherwise, one or more features of any of the embodiments described herein may be combined with any one or more features of other embodiments.

In the foregoing description, specific details are set forth to provide a thorough understanding of exemplary embodiments of the present disclosure. It will be apparent to one skilled in the art, however, that the embodiments disclosed herein may be practiced without embodying all of the specific details. In some instances, well-known process steps have not been described in detail in order not to unnecessarily obscure various aspects of the present disclosure. Further, it will be appreciated that embodiments of the present disclosure may employ any combination of features described herein.

The present application may include references to directions, such as "upper," "lower," etc. These references, and other similar references in the present application, are only to assist in helping describe and understand the particular embodiment and are not intended to limit the present disclosure to these directions or locations.

The present application may also reference quantities and numbers. Unless specifically stated, such quantities and numbers are not to be considered restrictive, but exemplary of the possible quantities or numbers associated with the present application. Also in this regard, the present application may use the term "plurality" to reference a quantity or number. In this regard, the term "plurality" is meant to be any number that is more than one, for example, two, three, four, five, etc. The term "about," "approximately," etc., means plus or minus 5% of the stated value.

For the purposes of the present disclosure, lists of two or more elements of the form, for example, "at least one of A, B, and C," is intended to mean (A), (B), (C), (A and B), (A and C), (B and C), or (A, B, and C), and further includes all similar permutations when any other quantity of elements is listed.

The principles, representative embodiments, and modes of operation of the present disclosure have been described in the foregoing description. However, aspects of the present disclosure, which are intended to be protected, are not to be construed as limited to the particular embodiments disclosed. Further, the embodiments described herein are to be regarded as illustrative rather than restrictive. It will be appreciated that variations and changes may be made by others, and equivalents employed, without departing from the spirit of the present disclosure. Accordingly, it is expressly intended that all such variations, changes, and equivalents fall within the spirit and scope of the present disclosure as claimed.

While illustrative embodiments have been illustrated and described, it will be appreciated that various changes can be made therein without departing from the spirit and scope of the invention.

The invention claimed is:

1. An inflatable attraction, comprising:

a central column coupled with a motion base;

an arm extending away from the central column, wherein the arm comprises an inflatable air chamber;

an inflatable brace extending from the central column to the arm; and a base portion disposed around the central column.

2. The inflatable attraction of claim 1, wherein the central column comprises a rigid frame member.

3. The inflatable attraction of claim 1, wherein the inflatable air chamber and the inflatable brace are fluidly connected.

4. The inflatable attraction of claim 3, wherein the inflatable air chamber is at least partially formed by an outer skin of the arm.

5. The inflatable attraction of claim 3, wherein the inflatable air chamber is a sealable air chamber disposed within the arm.

* * * * *